US005845716A

United States Patent [19]

Birk

[11] Patent Number: 5,845,716

[45] Date of Patent: Dec. 8, 1998

[54] METHOD AND APPARATUS FOR DISPENSING LIQUID WITH GAS

[75] Inventor: Aviezer Birk, Aberdeen, Md.

[73] Assignee: The United States of America as represented by the Secretary of the Army, Washington, D.C.

[21] Appl. No.: 946,863

[22] Filed: Oct. 8, 1997

[51] Int. Cl.[6] ..... A62C 2/00; A62C 13/62

[52] U.S. Cl. ..... 169/85; 169/9; 169/43; 169/71; 169/73; 239/405; 239/429

[58] Field of Search ..... 169/9, 14, 30, 169/43, 44, 71, 72, 73, 85; 239/429, 433, 405

[56] References Cited

U.S. PATENT DOCUMENTS

| | | | |
|---|---|---|---|
| 2,531,366 | 11/1950 | Smith | 169/73 |
| 4,601,344 | 7/1986 | Reed, Jr., et al. | 169/47 |
| 4,889,189 | 12/1989 | Rozniecki | 169/85 X |
| 5,305,957 | 4/1994 | Szocs | 169/85 X |
| 5,423,384 | 6/1995 | Galbraith et al. | 169/12 |
| 5,449,041 | 9/1995 | Galbraith et al. | 169/11 |
| 5,465,795 | 11/1995 | Galbraith et al. | 169/11 |
| 5,609,210 | 3/1997 | Galbraith et al. | 169/26 |
| 5,664,631 | 9/1997 | Szocs | 169/85 X |

*Primary Examiner*—Andres Kashnikow
*Assistant Examiner*—Robin O. Evans
*Attorney, Agent, or Firm*—Paul S. Clohan; William E. Eshelman

[57] ABSTRACT

A method and apparatus for dispensing a liquid, such as a fire suppressing agent, with a gas wherein both the liquid and a combustible propellant for generating the gas are stored in separate sealed compartments at atmospheric pressure. The liquid is stored in a chamber between an annular piston and a central pedestal containing a gas generating canister. A portion of the gas generated drives the piston to expel the liquid into a mixing chamber in the pedestal, and another gas portion is fed into the mixing chamber so as to mix with and propel the liquid through a nozzle. The liquid may be atomized or vaporized depending on its composition. Mixing of the liquid with the gas may be enhanced by tangentially injecting the liquid into the mixing chamber.

25 Claims, 3 Drawing Sheets

FIG. 1
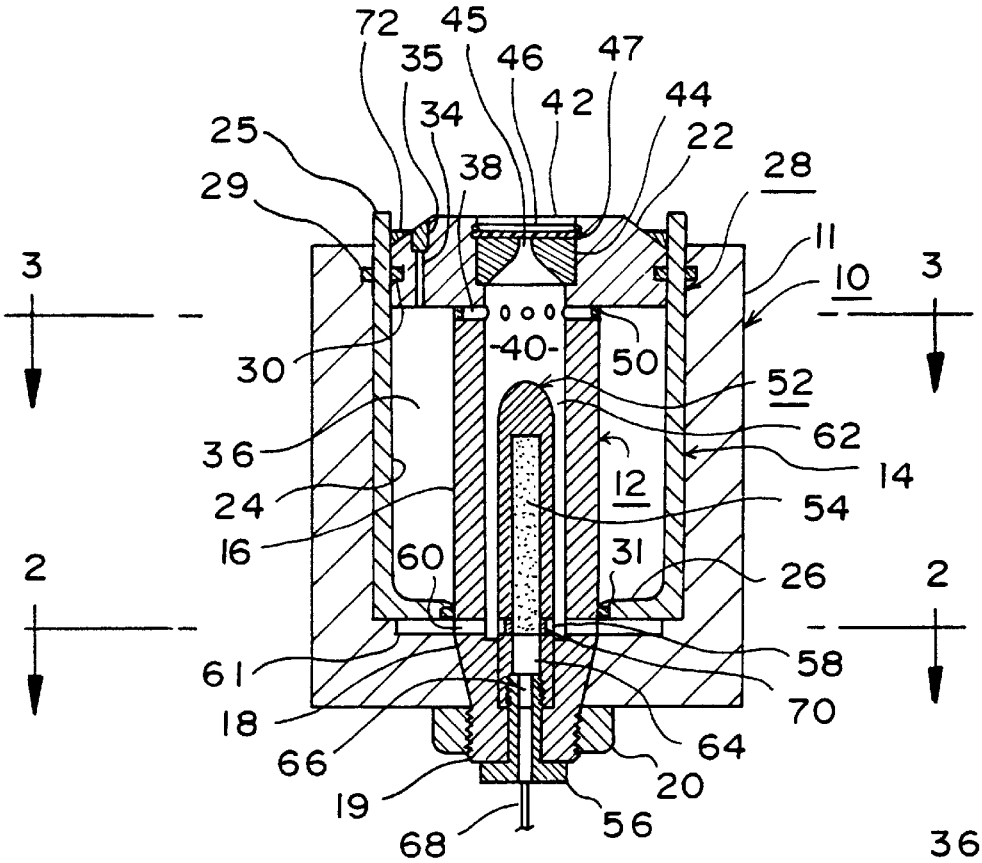
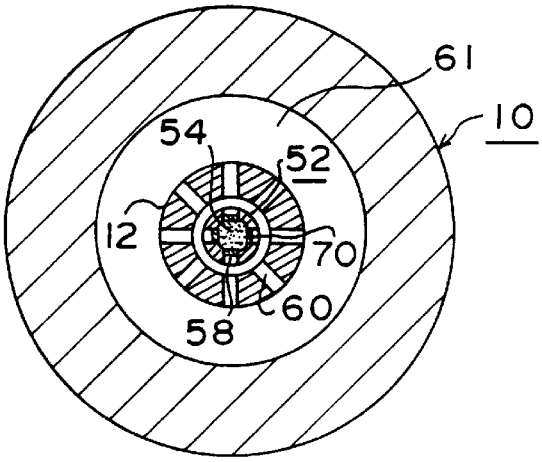
FIG. 2
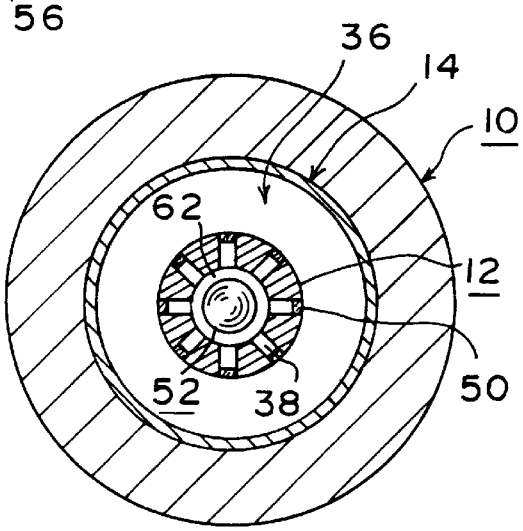
FIG. 3

FIG. 4
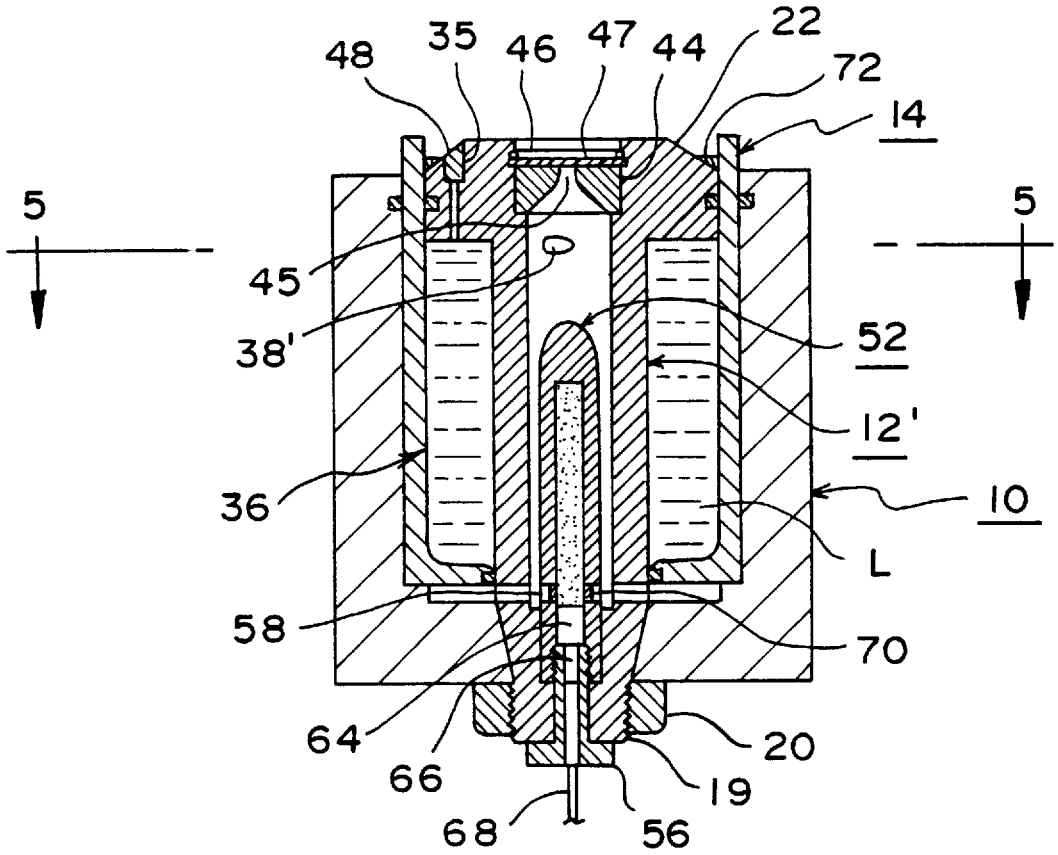
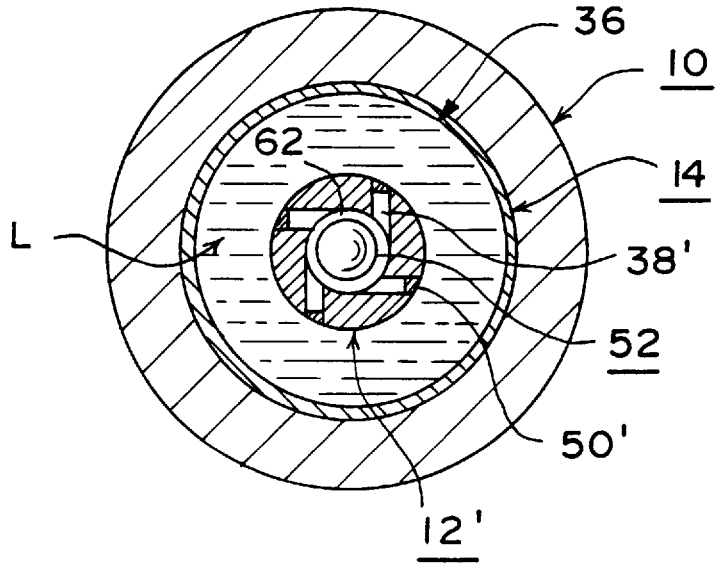
FIG. 5

METHOD AND APPARATUS FOR DISPENSING LIQUID WITH GAS

TECHNICAL FIELD

The invention relates to methods and devices for dispensing liquids with gases, and more particularly to a device for burning a solid propellant to rapidly dispense a liquid, such as a fire suppressant capable of rapidly extinguishing or inerting a fire in a confined space.

BACKGROUND OF THE INVENTION

The known mechanisms for fire suppression are heat deprivation, oxygen deprivation and chemical intervention. Conventional flame suppressant devices include those that eject fire suppressant agents in the form of sprays of liquids, powders, foams, or gases. In most of these devices, the suppressant agents are stored under pressure in a pressure vessel, and ejection is activated by causing a valve to open. Some common devices inject a water spray into the fire to suppress the fire by cooling it. Other common devices use carbon dioxide that is stored under pressure as a liquid, and this liquid flashes to carbon dioxide gas after ejection because it is no longer under pressure. The carbon dioxide gas cools the fire and also deprives it of oxygen by sweeping and dilution effects.

More advanced devices use halocarbons that are also stored under pressure and flash into a gas once they are ejected. Halocarbons containing bromine are especially effective because they suppress fires by both oxygen deprivation and chemical intervention. The bromine in the halocarbon combines with the hydrogen released in typical fires, thereby preventing the hydrogen from completing its reaction with oxygen to produce a flame. Halocarbons that do not contain bromine are less effective than bromine halocarbons.

Among the most efficient fire suppression agents are Halons. Halons are a class of brominated fluorocarbons and are derived from saturated hydrocarbons, such as methane or ethane, with their hydrogen atoms replaced with atoms of the halogen elements bromine, chlorine, and/or fluorine. This substitution changes the molecule from a flammable substance to a fire extinguishing agent. Fluorine increases inertness and stability, while bromine increases fire extinguishing effectiveness. The most widely used Halon is Halon 1301, $CF_3Br$, trifluorobromomethane. Halon 1301 extinguishes a fire in concentrations far below the concentrations required for carbon dioxide or nitrogen gas. Typically, a Halon 1301 concentration above about 3.3% by volume will extinguish a fire.

Halon fire suppression occurs through a combination of effects, including decreasing the available oxygen, isolation of fuel from atmospheric oxygen, cooling, and chemical interruption of the combustion reactions. The superior fire suppression efficiency of Halon 1301 is due to its ability to terminate the runaway reaction associated with combustion. However, Halons are being phased out because of their ozone depletion potential. As replacements, there are tropodegradable bromocarbons that, owing to their bromine content, are highly effective flame suppressants when vaporized. However, these bromine halocarbons must be atomized or vaporized because they are liquids at atmospheric pressure. There is therefore a need for an economical and reliable device that can employ liquid bromocarbons to suppress or extinguish fires.

SUMMARY OF THE INVENTION

The present invention provides a fire suppression device that can employ liquid bromocarbons and uses the gas from a gas generator to atomize and mix with them and then to inject the mixture into a fire so as to extinguish or suppress it. One advantage of this device is that it does not contain a fluid under pressure. Another advantage is that the different contents of the device are sealed separately and mix only upon activation of the device for use at the time of the fire. The device is operational under a wide range of ambient temperatures, such as the temperature ranges typically found in military specifications.

It is therefore a principle advantage of the dispensing device of the present invention that the dispensable liquid and the propellant are stored separately and at atmospheric pressure in sealed chambers. The gas generator is preferably a pyrotechnic canister containing a propellent that is combustible to generate mostly nitrogen gas, a preferred composition comprising azipolyol binders and tetrazole derivative fillers, more preferably a composition comprising sodium azide. The liquid to be dispensed may be a water solution of a salt having known fire suppression effectiveness, preferably a water solution of potassium lactate or of potassium acetate. Alternatively, the liquid may be a perfluorocarbon, preferably having an atmospheric boiling point above 65° C. and of known fire suppression effectiveness, such as octadecafluorooctane. A further alternative for the liquid is a tropodegradable bromocarbon, preferably having an atmospheric boiling point above 65° C. and of known fire suppression effectiveness, such as 3-bromo-1,1,1-pyrofluoro-2-propanol.

Due to its use of an internal gas generating scheme, the device may be constructed at low cost and is more compact and durable than prior art devices using a gas, either as the fire suppressant or as the propellant for a fire suppressant material. The internal gas generating scheme also provides for a controlled mixing of a gas propellant and a liquid fire suppressant agent inside a mixing chamber of the device. Therefore, the device may be used to eject fire suppressant agents that are designed as mixtures either of gases and vapors or of at least one gas and one atomized liquid spray. Because the device employs all three fire suppression mechanisms, namely heat deprivation, oxygen deprivation and chemical intervention, it is capable of fire suppression times substantially less than one second, preferably 5 milliseconds or less.

BRIEF DESCRIPTION OF THE DRAWINGS

The construction, operation and advantages of the present invention may be understood and appreciated more fully from the detailed description below taken in conjunction with the accompanying drawings, in which:

FIG. 1 is an elevational view in cross section of the invention before its activation;

FIG. 2 is a transverse cross-sectional view taken along lines 2—2 of FIG. 1;

FIG. 3 is a transverse cross sectional view taken along lines 3—3 of FIG. 1;

FIG. 4 is an elevational view in cross section showing a modification of the invention;

FIG. 5 is a transverse cross-sectional view taken along lines 5—5 of FIG. 4; and, FIG. 6 is an elevational view in cross section illustrating operation of the FIG. 1 embodiment.

DETAILED DESCRIPTION OF PREFERRED EMBODIMENTS

Figure 6:
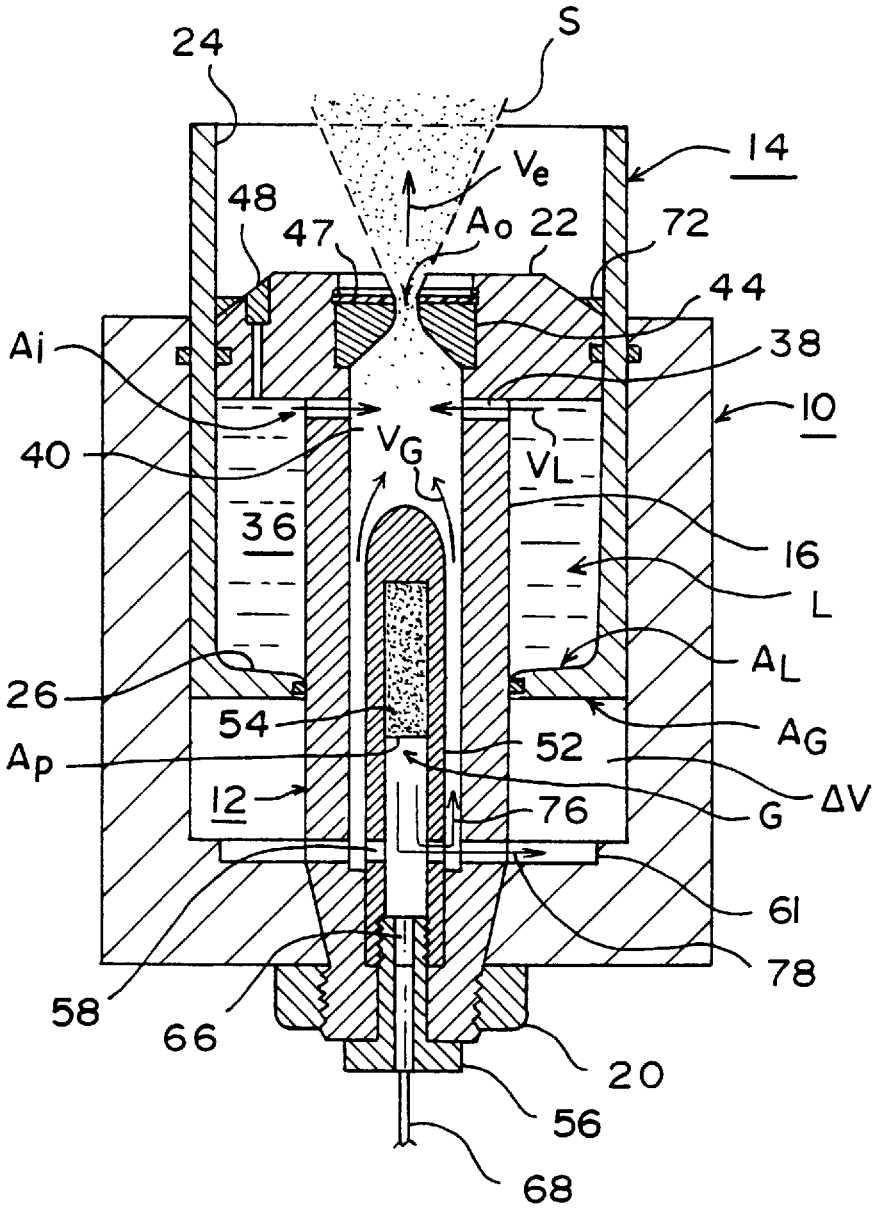

In FIG. 1 of the drawings, there is shown a preferred embodiment of the invention wherein a housing 10 contains a pedestal, generally designated 12, surrounded in part by an annular piston, generally designated 14. The housing 10 may be portable or fixed. The pedestal 12 includes a cylindrical barrel 16, a foot 18 having a threaded stem 19 secured in the bottom of the housing 10 by a nut 20, and a cap 22 welded or otherwise affixed to the distal end of barrel 16 opposite the foot 18.

Piston 14 has an annular cylindrical wall 24 extending perpendicular from an annular base 26 having an aperture for slidingly receiving barrel 16 of pedestal 12. Piston 14 is arranged for sliding movement along the barrel 16 and is guided in this movement by sliding contact between the base 26 and the barrel 16, and by sliding contact between the pedestal cap 22 and the piston wall 24 where the latter passes through an annular channel 28 defined by the outer peripheral surface of cap 22 and the inner opposing surface of housing wall 11. The outer end 25 of piston wall 24 is exposed to ambient pressure. The channel 28 contains seals 29 and 30 for slidingly engaging piston wall 24, and the aperture in piston base 26 contains a seal 31 for slidingly engaging the barrel 16.

The cap 22 contains a passage 34 that serves as an inlet for filling a chamber 36 between the piston wall 24 and the pedestal barrel 16 with a dispensable chemical composition, such as a liquid having fire suppressant characteristics. A plurality of radial outlet passages 38 connect chamber 36 with a mixing chamber 40 within hollow barrel 16, and chamber 40 has an outlet passage 42 containing a nozzle 44 held in position by snap ring 46. The orifice 45 of nozzle 44 is preferably sealed against dust and other contaminants by a rupturable diaphragm 47, which is designed to break in response to a rising gas pressure in mixing chamber 40. Inlet passage 34 has an enlarged outer bore 35 which is permanently closed by a plug or a valve 48 (FIG. 4) after chamber 36 is filled with the dispensable composition. Each outlet passage 38 is temporarily blocked by a frangible plug 50, which is made of a material that breaks up or disintegrates in response to a rising pressure within chamber 36.

Mounted within the barrel 16 below the mixing chamber 40 is a canister 52, which contains a combustible propellant 54 and is held in a central or concentric position within barrel 16 by a bolt 56 that passes through the threaded stem 19 of pedestal base 18 and has external threads that engage internal threads in the base of canister 52. Intermediate to the ends of canister 52 are a series of openings 58 for discharging gas that is generating by burning of the propellant 54, and aligned with these discharge openings are a series of gas passages 60 for exposing the piston base 26 to the gas pressure generated by the burning propellant. Although not shown, the gas passages 60 may also be sealed against contamination by a plug made of either a frangible material or a dislodgeable material. As described further below, a relatively small portion of the combustion gases will enter passages 60, while the main portion of the combustion gases will pass through an annular channel 62 between the outer surface of canister 52 and the inner surface of barrel 16. Upon exiting channel 62, the combustion gases mix in chamber 40 with the dispensable composition from chamber 36 and thereafter propel this composition through nozzle 44.

Although the propellant 54 may be ignited by a burning fuse or other means, it is preferably ignited by a booster charge 64 that in turn is ignited by primer 66 activated by an electrical current fed through an electrical wire 68. To maintain the propellant 54 and the booster 64 in a highly combustible condition, the gas discharge openings 58 are blocked and sealed by corresponding frangible plugs 70. In addition, to keep the piston 14 in its optimum fully retracted position, an adhesive is preferably used to provide a frangible ring 72 for detachably securing the outer end of piston wall 24 to the pedestal cap 22. Instead of an integral ring, the element 72 may be a ring of disconnected spots or patches of an adhesive, such as epoxy.

Referring now to FIGS. 4 and 5 of the drawings, there is a shown a second embodiment of the invention where the same numerals are used to designate elements that are substantially the same as those of the FIG. 1 embodiment. The only substantial difference between the FIG. 1 and the FIG. 4 embodiments is that the injection passages 38' from the injection chamber 36 enter the mixing chamber 40 tangentially as may be seen best in FIG. 5. Each of the injection passages 38' is maintained in a sealed condition by a frangible plug 50', which corresponds to the plug 50 in the radial passages 38 of the embodiments of FIGS. 1–3. FIGS. 4 and 5 also illustrate that, prior to use of either embodiment, the chamber 36 is filled with a liquid L.

Operation of the embodiments of FIGS. 1 and 4 will now be described with reference to FIG. 6. Upon application of an electrical current through the wire 68, the primer 66 fires and ignites the booster 64 which in turn ignites the propellant charge 54. The propellant preferably burns in a cigarette fashion providing a substantially constant planar burning area $A_P$. The frangible plugs 70 break loose to open the gas discharge openings 58, and then propellant gas G is discharged out of these openings so that a portion 76 thereof enters into the annular channel 62 through which it travels to reach the mixing chamber 40. A portion 78 of the propellant gas G also passes through the gas passages 60 where its pressure causes outward movement of the piston 14 as illustrated by the volume change $\Delta V$ of the chamber 61 beneath the piston base 26. This outward movement of piston 14 is a result of the gas side surface area $A_G$ being larger than the liquid side surface area $A_L$. Also as a result of this difference in surface areas on the opposite sides of the piston base 26, the liquid pressure becomes higher than the gas pressure, thereby creating a pressure differential across the frangible plugs 50 that dislodges them so that the liquid L in chamber 36 is injected through passages 38 into the mixing chamber 40 at a velocity $V_L$. Due to the pressure differential across the piston base 26, the adhesive ring or spots 72 break loose from the piston wall 24 so that piston 14 slides along the barrel 16 of pedestal 12 as the liquid L is injected into the mixing chamber 40. In the mixing chamber 40, the liquid L is mixed with the propellant gas G entering the mixing chamber 40 at a velocity $V_G$, which preferably is sufficiently high to atomize the liquid so that the liquid and gas are discharged from the nozzle 44 as a jet spray S having a velocity $V_e$.

The cross-sectional area $A_O$ of the nozzle orifice 45, and the rate of gas generation by the canister 52, are preferably selected so that the velocity $V_e$ of the gas and liquid mixture achieves sonic velocity when choked down to the orifice area $A_O$, this being the highest velocity achieved by the ejected mixture at the apex of the diverging cone of the spray S. After being released from the nozzle orifice, the material of the spray S may be an atomized liquid within the transport gas, or a gas and vapor mixture where the liquid particles formed in the mixing chamber 40 are subsequently vaporized.

The fire suppression device of the invention is very compact, durable and inexpensive, and has a 5 millisecond (ms) or less response time. The device has separate sealed chambers for the solid gas-generating charge and for the dispensable liquid agent, and both are maintained at atmospheric pressure. The solid charge is stored in the sealed canister, and the liquid is stored in the sealed annular chamber between the pedestal and the concentric piston wall. The burning rate of the charge is selected and the gas and liquid holes, passages and channels are sized to controllably mix the liquid agent with the hot inert gas and to output the entire contents through the choked nozzle at sonic velocity within a time period of less than 200 ms. The solid propellant, booster, and primer may be those used in common automotive airbags. Airbags employ sodium azide compositions for the generation of sodium-free nitrogen gas. Alternatively, the device may be operated with solid propellant compositions whose combustion product is primarily nitrogen gas, such as compositions containing azidopolyol binders and tetrazole derivative fillers.

By way of example, two different types of liquids may be used for suppressing or extinguishing fires. The first is a water and salt solution where the salt is a known effective fire suppressant, such as potassium acetate or potassium lactate. These solutions have much lower freezing points than water, and have been found to be ten to twenty times more effective than water for flame suppression. The device will output these solutions as sprays of atomized liquid particles shrouded by inert gas. The salt is delivered to the fire by the liquid particles, and becomes active as the particles vaporize in the fire. The second type of liquid is a perfluorocarbon such as octadecafluoroctane, or a tropodegradable bromocarbon such as 3-bromo-1,1,1-trifluoro-2-propanol. These liquids, which are considered to have good fire extinguishing capabilities, may be completely vaporized in the mixing chamber 40 when mixed with the hot gases, or as they are ejected from the nozzle 44.

It follows from the foregoing that the dispensing apparatus may utilize fire suppressing agents that do not contribute to ozone depletion. Other advantages of the invention include a dispensing apparatus that has compactness, low weight, durability, low cost and a response time of 5 milliseconds or less, and that may be actuated electrically. Electrical actuation may be initiated remotely by heat sensors mounted in strategic locations such as crew compartments, dry bays, engine compartments, and compartments for storing explosive or other flammable materials.

The physics of the operation shown in FIG. 6 may be described by the following equations:

The propellant 54 generates gas at a mass flow rate of:

$$m_G=\rho_p A_p a P_G^n \tag{1}$$

where a and n are the propellant burn rate coefficients, $\rho_P$ is the propellant density, and $A_p$ is the propellant burning area, and $P_G$ is the gas pressure.

The balance of force on the piston 14 is:

$$P_G A_G=P_L A_L \tag{2}$$

where $P_L$ is the liquid pressure, and $A_G$ and $A_L$ are the outer and inner cross-sectional areas of the piston base 26.

The liquid mass injection rate through passages 38 is:

$$m_L=\rho_L A_i V_L \tag{3}$$

where $\rho_L$ is the liquid density, $V_L$ is the liquid injection velocity, and $A_i$ is the total cross-sectional area of the liquid injection passages 38.

$V_L$ is found from the Bernoulli equation:

$$V_L = C_D\sqrt{2(P_L - P_G)/\rho_L} \tag{4}$$

where $C_D$ is the discharge coefficient and the other symbols are as already defined.

The mass flow rate out of the orifice 45 is:

$$m_E=m_G+m_L-\rho_G V_L A_i A_G/A_L \tag{5}$$

where $\rho_G$ is the gas density in gas chamber 61 and the other symbols are as already defined. $\rho_G$ is approximated from the gas equation:

$$\rho_G = \frac{P_G}{RT_F} \tag{6}$$

where R is the gas constant of the gas generated by the propellant, and $T_F$ is the propellant flame temperature.

Complex heat and mass transfer processes take place in the mixing chamber 40. The gas and liquid mass flow rates as defined by Equations 1 and 3 are so designed that, if a water and salt solution is used, the gas does not vaporize the solution, and if a perfluorocarbon or a bromocarbon is used, the liquid will be completely vaporized in chamber 40. Accordingly, the device will output a mixture that is either a gas and vapor cone or a gas and liquid spray. In any case, the device is designed to operate at $P_G$>10 bar, and this will result in a choked flow through orifice area $A_O$. This means that ejection velocity $V_e$ is the sound velocity of the mixture at $A_O$. $V_e$ can be estimated from:

$$\frac{1}{V_e^2} = \frac{\alpha}{S_G^2}\left[1+(1-\alpha)\left(\frac{\rho_{OL}}{\rho_{OG}}-1\right)\right]+\frac{1-\alpha}{S_L^2}\left[1+\alpha\left(\frac{\rho_{OL}}{\rho_{OG}}-1\right)\right] \tag{7}$$

where $S_L$ and $S_G$ are the sonic velocities of the mixture's liquid and gas components, $\rho_{OL}$ and $\rho_{OG}$ are its liquid and gas densities, and a is its gas void fraction, all at $A_O$ as calculated numerically from flow and fluid state equations.

The operating pressure $P_G$ in the gas chamber 61 is determined indirectly from equations 1–7.

For the case where the liquid is not vaporized in the device, the two-phase ejection velocity $V_e$ is substantially lower than the sonic velocity of either the liquid or gas phase alone. The result is a steep pressure drop at the outlet of the device as the two phase mixture expands to atmospheric pressure. This leads to fine atomization of the liquid and formation of a gas and liquid spray jet S having the shape of a diverging cone.

If tangential liquid injection passages 38' are used instead of radial passages 38, the pressures may be higher and the ejected flow mixture will swirl out of orifice 45, resulting in an increased spread angle of the spray jet.

While the invention has been described above in conjunction with the preferred embodiments thereof, many changes, modifications, alterations and variations will be apparent to those skilled in the art when they learn of the invention. Thus, although the invention is described in conjunction with discharging a fire suppressant composition, it is also applicable to the discharge of a wide variety of fluids, whether they be liquids, gases or fluidized solids. For example, the apparatus may be used as a smoke or insecticide generator, or as a generator for any other substance needing to be dispersed rapidly into the environs. It is also practical to provide a pressurized gas in gas chamber 61 by a gas supply means other than the canister 52. For example, the booster charge, primer and electrical wire may be removed from the base of the pedestal 12, and a gas canister or other gas source attached externally to the threaded stem 19 of the pedestal 12. Accordingly, the preferred embodiments of the invention set forth above are intended to be illustrative, not limiting, and various changes may be made without departing from the spirit and scope of the invention as defined by the claims set forth below.

What is claimed is:

1. An apparatus for discharging a liquid with a gas, said apparatus comprising:

a housing having a wall defining a piston chamber;

a pedestal extending through at least a portion of said piston chamber and having a hollow barrel defining a mixing chamber;

an annular piston arranged for movement in said piston chamber and extending between said housing wall and said barrel to provide a liquid chamber for holding the liquid when said piston is in a retracted position;

at least one liquid passage connecting said liquid chamber and said mixing chamber;

a gas chamber arranged in said housing to exert a pressure of the gas against a first face of said piston opposite to a second face for contacting the liquid in said liquid chamber;

gas supply means for providing the gas in said gas chamber at said pressure, the area of said first piston face being larger than the area of said second piston face so that said gas pressure causes said piston to force the liquid out of said liquid chamber and into said mixing chamber through said liquid passage(s);

means for conveying a portion of said gas into said mixing chamber for admixing with said liquid to form a gas and liquid mixture; and nozzle means for discharging said mixture from said mixing chamber to ambient pressure.

2. An apparatus according to claim 1, wherein said gas supply means comprises a combustible propellant charge, and means for igniting said propellant charge.

3. An apparatus according to claim 2, wherein said propellant charge is contained in a propellant chamber defined by a canister member, and wherein said apparatus further comprises conduit means for conveying said gas portion from said propellant chamber to said mixing chamber.

4. An apparatus according to claim 3, wherein said conduit means includes at least one passage through a wall of said canister member, and wherein said at least one passage is sealed by plug that is frangible in response to the combustion of said propellant charge.

5. An apparatus according to claim 3, wherein said means for igniting the propellant charge is electrically actuated.

6. An apparatus according to claim 1, wherein said liquid chamber is connected to said mixing chamber by a plurality of liquid passages, each of which is sealed by a plug that is frangible in response to a liquid pressure in said liquid chamber generated by the pressure applied by said gas to the first face of said piston.

7. An apparatus according to claim 1, wherein said at least one liquid passage is arranged to inject liquid into said mixing chamber in a tangential direction relative to an axis of said mixing chamber, such that said injected liquid causes a swirling motion for mixing the liquid with said gas portion.

8. The apparatus of claim 1, wherein said at least one liquid passage is sealed by a plug that is frangible in response to a liquid pressure in said liquid chamber generated by the pressure of said gas applied to the first face of said piston.

9. The apparatus of claim 1, wherein said piston comprises a base with said first and second faces, and an annular sidewall extending from said base adjacent and substantially parallel to the said housing wall; and wherein an outer portion of said annular sidewall is guided between said housing wall and a cap member of said pedestal mounted on an outer end of said barrel.

10. An apparatus according to claim 9 further comprising first seal means extending between said housing wall and said piston sidewall, second seal means extending between said cap member and said piston sidewall, and third seal means extending between said piston base and said pedestal barrel, each of said seal means being arranged to prevent leakage of said liquid from said liquid chamber when said gas pressure is applied to the first face of said piston.

11. An apparatus according to claim 1, wherein said gas supply means comprises a pyrotechnic gas generator mounted in the barrel of said pedestal.

12. An apparatus according to claim 1, wherein said gas supply means comprises a canister having a propellant chamber containing a combustible propellant, and at least one gas passage for discharging from said propellant chamber gas generated by combustion of said propellant; and wherein said at least one liquid passage and said at least one gas passage are each sealed by a frangible plug such that said liquid and said propellant are stored separately in sealed chambers.

13. An apparatus according to claim 1 for suppressing a fire, and wherein said liquid comprises a fire suppressant composition.

14. An apparatus according to claim 13, wherein said liquid is a water solution of a salt having fire suppression characteristics.

15. An apparatus according to claim 14, wherein said salt is potassium lactate or potassium acetate.

16. An apparatus according to claim 13, wherein said liquid is a perfluorocarbon having an atmospheric boiling point above 65° C.

17. An apparatus according to claim 13, wherein said liquid is a tropodegradable bromocarbon having an atmospheric boiling point above 65° C.

18. An apparatus according to claim 1, wherein said gas supply means comprises a pyrotechnic gas generator containing a propellant composition that upon combustion generates nitrogen gas as a propellant.

19. An apparatus according to claim 18, wherein said propellant composition is sodium azide.

20. An apparatus according to claim 18, wherein said propellant composition comprises azidopolyol binders or tetrazole derivative fillers or both said binders and said fillers.

21. An apparatus according to claim 1, wherein said gas supply means comprises a canister containing a combustible propellant composition in a combustion chamber, and conduit means connecting said combustion chamber to said mixing chamber; wherein said canister is mounted in said pedestal barrel so that said mixing chamber is between said canister and said nozzle means; and wherein said conduit means comprises an annular channel between said canister and a concentric wall of said pedestal barrel, and at least one gas passage connecting said annular channel with said combustion chamber.

22. An apparatus according to claim 1, wherein said nozzle means includes a diaphragm for sealing a discharge orifice, said diaphragm being rupturable by a gas pressure in said mixing chamber greater than ambient pressure.

23. A method of dispensing a liquid from a container, said method comprising:

providing the liquid in a liquid chamber of the container, said liquid chamber containing a piston arranged for movement therein and having a first face opposite to a second face for engaging said liquid;

generating a gas by burning a propellant in a propellant chamber;

applying a pressure of said gas to the first face of said piston to pressurize said liquid and cause it to be injected into a mixing chamber of the container through at least one liquid passage connecting said liquid chamber to said mixing chamber upstream of an outlet open to ambient pressure, the area of said first piston face being larger than the area of said second piston face so that the pressure of said gas causes said piston to force the liquid out of said liquid chamber and into said mixing chamber through said liquid passage(s);

conveying a portion of said gas into said mixing chamber and mixing it with said liquid to form a gas and liquid mixture; and, discharging said mixture from said mixing chamber to ambient pressure through said outlet, the velocity of the portion of said gas conveyed to said mixing chamber being sufficient to atomize at least a portion of the liquid in said mixture.

24. A method according to claim 23, wherein the container has a wall defining a piston chamber, and a pedestal extending through at least a portion of said piston chamber and having a hollow barrel defining said mixting chamber; wherein said piston is an annular piston arranged for movement in said piston chamber and extends between said container wall and said barrel to provide said liquid chamber for holding the liquid when said piston is in a retracted position; and wherein a gas chamber is arranged in said container to apply the pressure of said gas against the first face of said piston.

25. A method according to claim 23, wherein said at least one liquid passage is arranged to inject liquid into said mixing chamber in a tangential direction relative to an axis of said mixing chamber, such that said injected liquid causes a swirling motion for mixing the liquid with said gas portion.

* * * * *